US010707588B2

(12) United States Patent
Osswald et al.

(10) Patent No.: US 10,707,588 B2
(45) Date of Patent: Jul. 7, 2020

(54) PLUG CONNECTION FOR ELECTRICAL CONTACTING OF A CIRCUIT BOARD

(71) Applicant: Endress+Hauser SE+Co. KG, Maulburg (DE)

(72) Inventors: Dirk Osswald, Schopheim (DE); Andreas Wehrle, Schopfheim (DE); Christian Blansche, Rheinfelden (DE)

(73) Assignee: Endress+Hauser SE+Co. KG, Maulburg (DE)

( * ) Notice: Subject to any disclaimer, the term of this patent is extended or adjusted under 35 U.S.C. 154(b) by 0 days.

(21) Appl. No.: 16/305,281

(22) PCT Filed: May 18, 2017

(86) PCT No.: PCT/EP2017/061922
§ 371 (c)(1),
(2) Date: Nov. 28, 2018

(87) PCT Pub. No.: WO2017/207285
PCT Pub. Date: Dec. 7, 2017

(65) Prior Publication Data

US 2019/0386404 A1 Dec. 19, 2019

(30) Foreign Application Priority Data

May 31, 2016 (DE) ..... 10 2016 110 050

(51) Int. Cl.
*H01R 4/30* (2006.01)
*H01R 4/34* (2006.01)
(Continued)

(52) U.S. Cl.
CPC ..... *H01R 4/34* (2013.01); *H01R 4/44* (2013.01); *H01R 9/2491* (2013.01);
(Continued)

(58) Field of Classification Search
CPC ..... H01R 4/34; H01R 12/725; H01R 9/2491; H01R 4/44; H01R 12/515; H01R 12/75; H01R 12/57; H01R 11/05
(Continued)

(56) References Cited

U.S. PATENT DOCUMENTS 4,595,248 A 6/1986 Brown
4,797,007 A * 1/1989 Elmore, III ..... G01K 13/02 374/143
(Continued)

FOREIGN PATENT DOCUMENTS

CN 101522009 A 9/2009
CN 201515046 U 6/2010
(Continued)

OTHER PUBLICATIONS

Search Report for German Patent Application No. 10 2016 110 050.1, German Patent Office, dated May 10, 2017, 5 pp.
(Continued)

*Primary Examiner* — Jean F Duverne
(74) *Attorney, Agent, or Firm* — Kelly J. Smith; Endress+Hauser (USA) Holding Inc.

(57) ABSTRACT

The disclosure relates to a plug connection, including a plug socket and a clamp plug, for the electrical contacting of a circuit board located in an inner space of a field device. The plug socket is arranged on the circuit board and has at least one web and a first guiding arrangement. The clamp plug includes a second guiding arrangement, which is complementary to the first guiding arrangement, and further includes at least one clamping apparatus. The plug connection also includes an electrical cable that is clampable onto the web.

16 Claims, 4 Drawing Sheets

(51) Int. Cl.

| | |
|---|---|
| ***H01R 4/44*** | (2006.01) |
| ***H01R 9/24*** | (2006.01) |
| ***H01R 12/51*** | (2011.01) |
| ***H01R 12/72*** | (2011.01) |
| ***H01R 12/75*** | (2011.01) |
| *H01R 11/05* | (2006.01) |
| *H01R 12/57* | (2011.01) |

(52) U.S. Cl.
CPC ..... *H01R 12/515* (2013.01); *H01R 12/725* (2013.01); *H01R 12/75* (2013.01); *H01R 11/05* (2013.01); *H01R 12/57* (2013.01); *H01R 2201/20* (2013.01)

(58) Field of Classification Search
USPC ..... 439/801
See application file for complete search history.

(56) References Cited

U.S. PATENT DOCUMENTS

| | | | | |
|---|---|---|---|---|
| 5,624,269 | A | 4/1997 | Kanamori | |
| 7,404,745 | B1 | 7/2008 | Wu | |
| 7,534,151 | B1 | 5/2009 | Billerbeck | |
| 7,927,156 | B2 * | 4/2011 | Appel | H05K 1/0256 439/709 |
| 2006/0094306 | A1 | 5/2006 | Masaki et al. | |
| 2014/0087599 | A1 | 3/2014 | Schumacher | |

FOREIGN PATENT DOCUMENTS

| | | | |
|---|---|---|---|
| CN | 103296503 | A | 9/2013 |
| CN | 104882682 | A | 9/2015 |
| DE | 9312961 | U1 | 1/1994 |
| DE | 202009010474 | U1 | 4/2010 |
| DE | 102013111696 | A1 | 4/2015 |
| EP | 2768081 | A1 | 8/2014 |
| FR | 2822014 | A1 | 9/2002 |
| JP | 2010186663 | A | 8/2010 |
| JP | 2014049351 | A | 3/2014 |
| JP | 2014143009 | A | 8/2014 |

OTHER PUBLICATIONS

Search Report for International Patent Application No. PCT/EP2017/061922, WIPO, dated Aug. 11, 2017, 12 pp.

* cited by examiner

PLUG CONNECTION FOR ELECTRICAL CONTACTING OF A CIRCUIT BOARD

CROSS-REFERENCE TO RELATED APPLICATIONS

The present application is related to and claims the priority benefit of German Patent Application No. 10 2016 110 050.1, filed on May 31, 2016 and International Patent Application No. PCT/EP2017/061922, filed on May 18, 2017 the entire contents of which are incorporated herein by reference.

TECHNICAL FIELD

The invention relates to a plug connection for electrical contacting of a circuit board located in an inner space of a housing part.

BACKGROUND

In automation technology, especially in process automation technology, field devices are often applied, which serve for registering and/or influencing process variables. Serving for registering process variables are sensors, which are integrated, for example, in fill level measuring devices, flow measuring devices, pressure- and temperature measuring devices, pH-redox potential measuring devices, conductivity measuring devices, etc., for registering the corresponding process variables, fill level, flow, pressure, temperature, pH-value, redox potential, or conductivity register. Serving for influencing process variables are actuators, such as, for example, valves or pumps, via which the flow of a medium in a pipeline section, or the fill level in a container, can be changed. Referred to as field devices are, in principle, all devices, which are applied near to the process and which deliver, or process, process relevant information. In connection with the invention, the terminology, field devices, thus refers also to remote I/Os, radio adapters, or generally electronic components, which are arranged at the field level. A large number of such field devices are produced and sold by the firm, Endress+Hauser.

Independently of the particular field device type, field devices are, as a rule, connected via a bus system with a superordinated unit, for example, a process control system. This serves, on the one hand, for reporting the registered process variables. Due to its robustness, used as signal type for this is a standard signal, as a rule, the 4-20 mA signal. Moreover, also additional information, for example, concerning the operating state of the field device, can be communicated to the superordinated unit. For this, supplementally, a digital signal is modulated onto the 4-20 mA signal. Conventional protocols in the field of process automation are, for instance, "PROFIBUS", "HART" or "Wireless HART".

Since, independently of the particular field device type, the same communication protocol to the superordinated unit can be used, it is possible for the manufacturer to use the same communication module in different field device types. In this way, there results the opportunity for modular manufacturing in the case of a large number of different field device types. For this, it is, however, necessary that the circuit board or assembly, on which the communication module is located, be adapatable to the different field device types.

Known from the publication WO 2015/147993 is a circuit board plug connection, which can be used in a field device.

Shown there is a plug with a plurality of connection pins, wherein a connector of an electrical wire can be screwed, in each case, onto one pin. Because of the pins, it is easy to plug the plug into corresponding sockets on the circuit board. However, in the case of this type of plug connection, a protection against slipping out of the plug is not provided.

SUMMARY

An object of the invention is to provide a simply and safely contactable plug connection to a circuit board, in such a manner that the circuit board is applicable for a large number of field device types.

The invention achieves this object with a plug connection for electrical contacting of a circuit board located in an inner space of a housing part, wherein the housing part is associated with a field device. In such case, the plug connection includes:

- a plug socket arranged on the circuit board and having
  - at least one web, and
  - a first guiding arrangement
- and
- a clamp plug having
  - a second guiding arrangement, which is embodied complementary to the first guiding arrangement, and
  - at least one clamping apparatus, by means of which at least one connection of at least one electrical cable is clampable onto the at least one web.

In this way, the electrical contacting of the cable is assured. By simultaneous clamping onto the web, the clamp plug is supplementally also secured against slipping out.

Preferably, the second guiding arrangement is embodied complementary to the first guiding arrangement in such a manner that the clamp plug is pluggable via the two guiding arrangements into the plug socket essentially planparallelly with the circuit board.

To the extent that the circuit board includes in at least one subregion a lid for encapsulation of components located on the circuit board, a very compact embodiment of the clamp connection provides that the first guiding arrangement is embodied as an integral component of the lid.

For the case, in which the plug connection serves for contacting a communication module of a field device, the plug socket includes a plurality of webs and the clamp plug a corresponding number of clamping apparatuses. Since, in the case of field devices, the sensor value is, as a rule, transmitted by means of 4-20 mA signals, this means usually two webs for implementing the electrical current loop, and four in the case of separate voltage supply of the field device.

In an advantageous embodiment, the clamping apparatus is so implemented that it includes

- an electrically insulating platform, with
  - at least one hollow with an internal thread, and
  - the second guiding arrangement, and
- at least one clamping screw screwable into the at least one internal thread.

Alternatively, an option is to embody the clamping apparatus very simply in the form of a so-called crocodile clip.

In the case, in which the plug connection is implemented via at least one clamp-screw, the clamp connection is preferably so embodied that the at least one web is arranged essentially planparallel with the circuit board and has a first cutout. In such case, the at least one internal thread is arranged in such a manner within the insulating platform that the at least one clamping screw in the case of plugged-in clamp plug extends through the at least a first cutout, and that between the at least one web and the screw head of the at least one clamping screw in the screwed state at least one connection of an electrical cable is clampable.

In this way, in the case of the screwing tight of the at least one clamping screw no torque is exerted on the at least one web, it is advantageous that on the at least one clamping screw at least one electrically conductive underlay washer is arranged. Thus, the web does not have to be supplementally mechanically secured and can be embodied, for example, as an SMD-solderable component.

To the extent that on the at least one clamping screw an underlay washer is arranged, there is the additional opportunity that the at least one underlay washer includes a seat for connecting an electrical measuring- and test device. In this way, it is enabled that a check of the functioning of the communication module can still occur after the circuit board has been installed in the housing part.

Advantageously in the case of the clamp connection with at least one clamping screw screwable into an internal thread, the at least one internal thread is embodied as a nut, which is set in the platform. In such case, especially advantageous is when the nut is set freely movably in the platform in such a manner that in the non-plugged state of the clamp plug it is removable from the platform in the direction toward the screw head of the clamping screw. Above all, this embodiment of the clamp plug permits that the at least one web is embodied as an SMD-solderable component. The reason for this is that in the case of such an arrangement of the nut in the case of the screwing tight of the at least one clamping screw, no torque, and, above all, no force, is exerted on the at least one web in the direction of the circuit board.

A grounding of the housing part via the plugged connection can be achieved by providing the clamp plug with a contacting element for electrical contacting of the housing part. Proviso for this is that the housing part be embodied conductively, at least in appropriate sections.

This type of grounding can be implemented by providing the contacting element in the form of a screw, which is guided through the clamp plug by means of a sleeve, wherein the housing part has, matching the screw, an internal thread, into which the screw can be screwed in the plugged state of the clamp plug.

Depending on design, it can be necessary that the circuit board has a second cutout to allow the contacting element to pass through the circuit board.

To the extent that the plug socket includes a plurality of webs and the clamp plug a corresponding number of clamping apparatuses, it is from a safety point of view advantageous that the platform has insulation for electrical insulation between the connections of the electrical cable in the region of the screwheads of the clamping screws. In this way, it is prevented that during attachment a short circuit could be caused between the clamping screws, whereby components located on the circuit board could possibly be destroyed. For purposes of simpler attachment, it is, in turn, advantageous that the clamp plug be embodied in such a manner that a complete screwing out of the at least one clamping screw is prevented.

BRIEF DESCRIPTION OF THE DRAWINGS

The invention will now be explained in greater detail based on the appended drawing, the figures of which show as follows.

DETAILED DESCRIPTION

Figure 1:
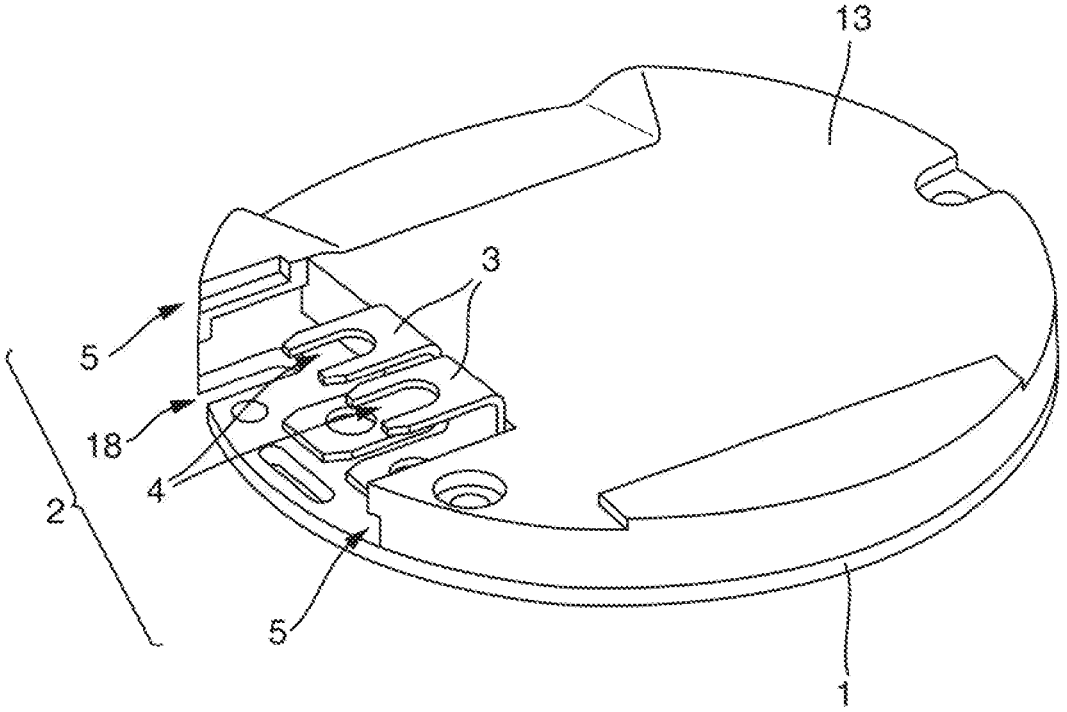
FIG. 1 shows a circuit board with a plug socket of the invention.

FIG. 1 shows a circuit board 1 with an embodiment of a plug socket 2 of the invention, wherein the plug socket 2 serves for electrical contacting of components located on the circuit board 1 by means of a clamp plug 6.

The plug socket 2 includes in the illustrated example of an embodiment two webs 3, which are arranged essentially planparallel with the surface of the circuit board 1, each with a first cutout 4. The two webs 3 of the plug socket 2 can be, for example, the connections needed for the transmission of the standardized signals. As usual in the case of field devices, as a rule, the 4-20 mA standard is used here, which can additionally be superimposed with a digital signal, for example, according to the HART protocol.

The two webs 3 are embodied in the illustrated embodiment as SMD-solderable components. Accordingly, no traversing bores need be present in the circuit board 1 for the two webs 3.

For encapsulation of components located on the circuit board 1, a lid 13 is arranged on the circuit board 1. With exception of the plug socket 2, the lid 13 covers the surface of the circuit board 1 completely in the illustrated example of an embodiment. Moreover, the lid 13 includes a first guiding arrangement 5, composed of two guide rails. The guiding arrangement 5 and the cutouts 4 of the webs 3 are arranged in such a manner that the clamp plug 6 can be plugged, for instance, planparallelly from the edge of the circuit board 1 into the plug socket 2.

In the case of the example of an embodiment shown in FIG. 1, the circuit board 1 includes in the region of the plug socket 2 additionally a second cutout 18. It enables that between the clamp plug 6 and a housing part 14, to which the circuit board 1 is secured, an electrical contact can be produced by means of a contacting element 17 mounted on the clamp plug 6. Such a contacting can be required, for example, in order to connect the housing part 14 with a ground potential of the clamp plug 6. Proviso for this is, naturally, appropriate embodiments of the clamp plug 6 and the housing part 14.

Figure 2A:
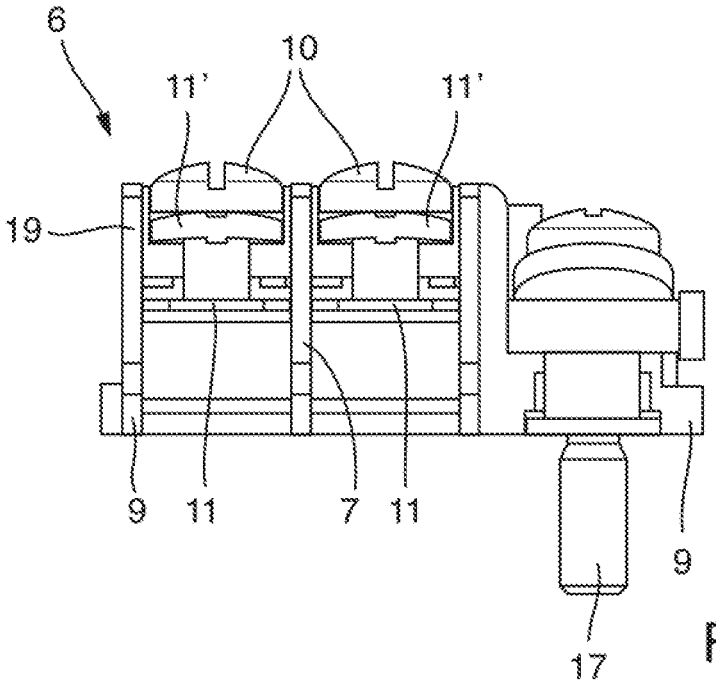
FIG. 2 shows a clamp plug connectable to the plug socket.
Figure 2B:
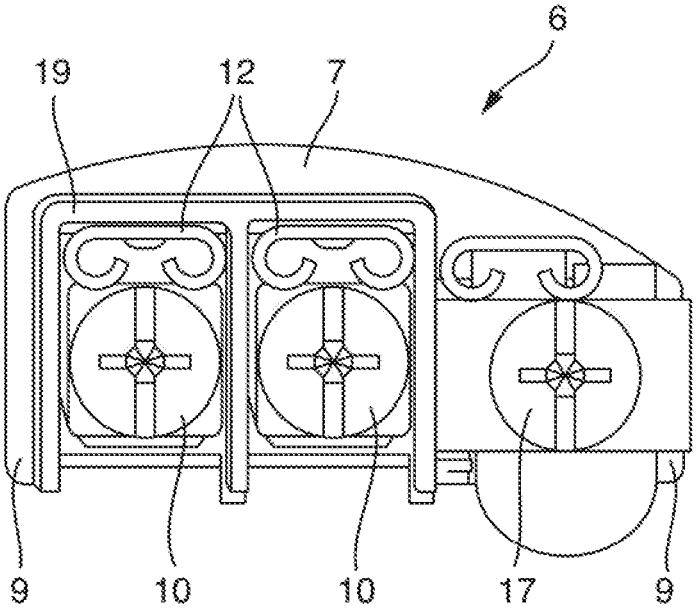

An embodiment of the clamp plug 6, which is pluggable into the plug socket 2 shown in FIG. 1, is shown in front view in FIG. 2*a* as well as in plan view in FIG. 2*b*. Corresponding to the two webs 3 of the plug socket 2, this embodiment of the clamp plug 6 includes two clamping apparatuses in the form of two clamping screws 10. The clamping screws 10 are screwable into an electrically insulating platform 7 in such a manner that the screwheads of the clamping screws 10 can, in each case, provide a clampable connection to an electrical cable. In order that the cable connection, for example, of a litz cable, is not directly clamped by the rotatable screwheads, the clamping screws 10 of the embodiment shown in FIGS. 2*a* and 2*b* include, in each case, two electrically conductive washers 11, 11'. For protection against possible short circuits between the connections of the electrical cable, the platform 7 in the region of the screwheads of the two clamping screws 10 includes insulation 19.

For fitting the first guiding arrangement 5 on the lid 13, the platform 7 of the clamp plug 6 includes a second guiding arrangement 9 of two guiding rails, via which the clamp plug 6 is pluggable essentially planparallelly with the circuit board 1 into the plug socket 2.

In the case of the embodiment shown in FIGS. 2*a* and 2*b*, the clamp plug 6 includes, moreover, a contacting element 17 embodied as a screw. It serves to contact the housing part 14 via the clamp plug with the ground. Accordingly, housing part 14 must have for this a suitable internal thread and be embodied conductively in at least this region.

Figure 3A:
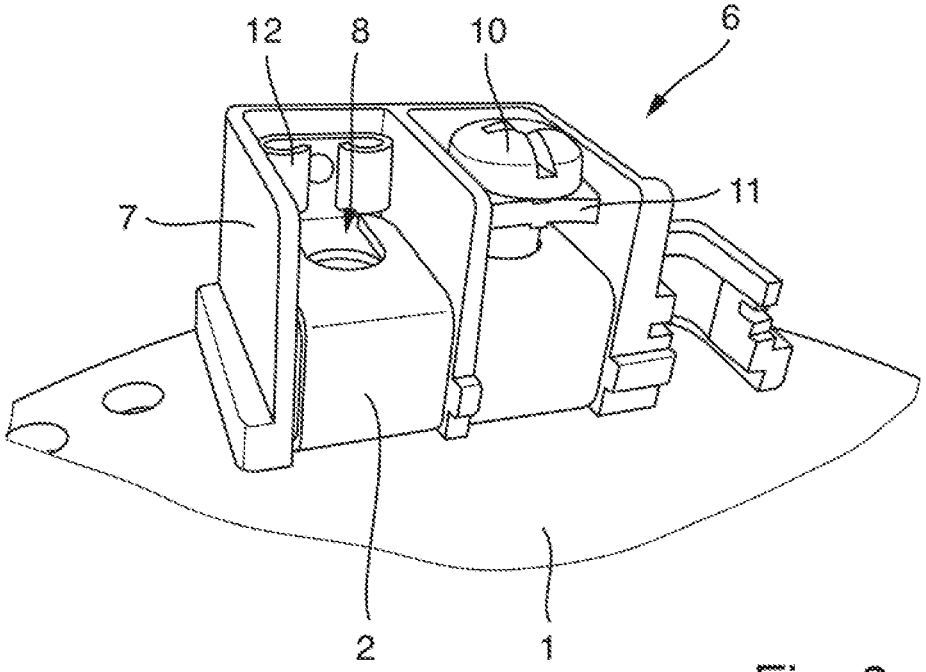
FIG. 3 shows the plug socket and the clamp plug in the connected state.
Figure 3B:
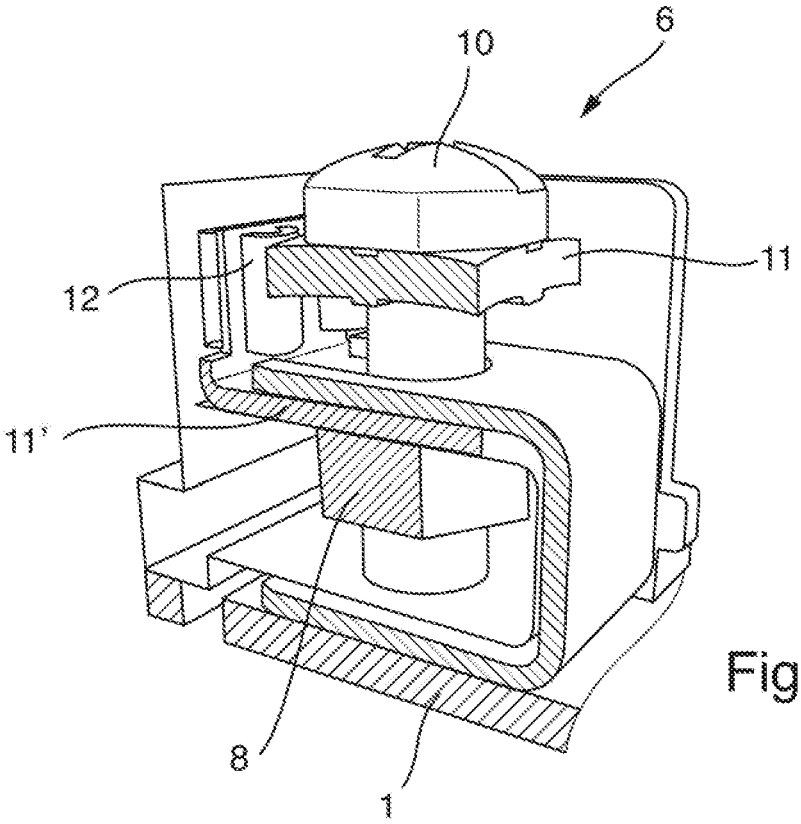

FIGS. 3*a* and 3*b* show in detail how the clamp plug 6 shown in FIG. 2*a* and FIG. 2*b* is arranged in the plug socket 2 of the circuit board. For better visibility, the lid 13 of the circuit board 1 is not present in these two figures. Shown is that the web 3 lies above the lower underlay washer 11' on the platform 7. In such case, the two clamping screws 10 are arranged in such a manner on the platform 7 that, in the case of plugged-in clamp plug 6, they extend, in each case, through the first cutout 4. Thus, a connection of an electrical cable is clampable between a particular web 3 and the corresponding upper underlay washer 11 in the screwed state.

The two clamping screws 10 are connected with the platform via corresponding internal threads 8. Each internal thread is embodied in the shown example of an embodiment as a nut, which is set in the platform 7.

In the case of the example of an embodiment shown in FIGS. 3*a* and 3*b*, the lower underlay washer 11' includes additionally an upwardly angled end having a seat 12. This can be used as connection for an electrical measuring- and testing device. This variant offers the advantage that the functioning of components located on the circuit board 1 can still be tested when the circuit board 1 is mounted in the provided housing part 14.

Figure 4:
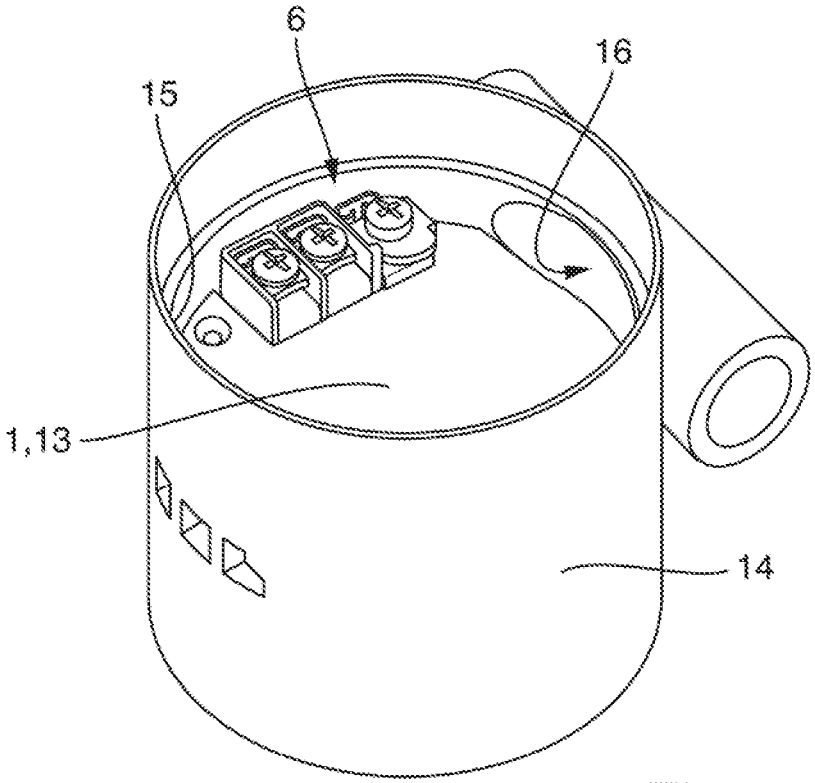
FIG. 4 shows the circuit board with the plug socket and the clamp plug in a housing part.

FIG. 4 shows the circuit board 1 in an inner space 15 of the housing part 14. In such case, the circuit board 1 has a plugged in, upwardly accessible clamp plug 6, via which the plug socket 2 is contacted. The combination of plug socket 2 and clamp plug 6 includes two clamping screws 10 and a ground-contact for the housing part.

One or more connection cables are led into the inner space 15 via a feedthrough 16. In the case of field devices, which communicate with a superordinated unit, typically these are the two signal lines required for the 4-20 mA measuring signal. According to the invention, the connections of the lines, to the extent that they are terminal strands or comparable terminations, can be clamped to the webs 3 by tightening the clamp screws 10, without that the webs 3 experience torsion because of the screwing action. A possible breaking of a web 3 from the circuit board 1 during the tightening is prevented by this feature.

A further advantage of the plug connection of the invention is that, in the case of field device types, in the case of which the plug socket 2 of the circuit board 1 does not need to be contacted, instead of the clamp plug 6, a suitable protection cap can be plugged in to superimpose on the plug socket 2. This enables use of the equally constructed circuit board 1 in an expanded number of field device types.

The invention claimed is:

1. A plug connection for electrical contacting of a circuit board located in an inner space of a housing part, wherein the housing part is associated with a field device, the plug connection comprising:

a plug socket arranged on the circuit board and having:

at least one web; and a first guiding arrangement;

and a clamp plug having:

a second guiding arrangement complementary to the first guiding arrangement; and at least one clamping apparatus configured to clamp at least one electrical cable onto the at least one web; and wherein during combination of the plug socket and the clamp plug, at least a portion of the clamping apparatus is received between free ends of the web.

2. The plug connection of claim 1, wherein the clamp plug is pluggable, via the first and second guiding arrangements, into the plug socket plane-parallelly with the circuit board.

3. The plug connection of claim 1, wherein the circuit board includes in at least one subregion a lid for encapsulation of components located on the circuit board, and wherein the first guiding arrangement is an integral component of the lid.

4. The plug connection of claim 1, wherein the plug socket further includes a plurality of webs and the clamp plug includes a corresponding number of clamping apparatuses.

5. The plug connection of claim 1, wherein the at least one web is soldered to the plug socket.

6. The plug connection of claim 1, wherein the clamping apparatus includes an electrically insulating platform including the second guiding arrangement, at least one hole with internal threads, and at least one clamping screw screwable into the hole via the internal threads.

7. The plug connection of claim 6, wherein the at least one web is plane-parallel with the circuit board and has a first cutout, and wherein the internal threads are arranged within the insulating platform such that the at least one clamping screw extends through the first cutout, and wherein at least one electrical cable is clamped between the at least one web and a screw head of the at least one clamping screw.

8. The plug connection of claim 6, wherein at least one conductive underlay washer is arranged on the at least one clamping screw.

9. The plug connection of claim 8, wherein the at least one underlay washer includes a seat for connecting an electrical measuring and test device.

10. The plug connection of claim 6, wherein the platform includes a nut, and the nut includes the internal threads.

11. The plug connection of claim 10, wherein, in a non-connected state of the plug socket and the clamp plug, the nut is movable within the platform toward a screw head of the clamping screw.

12. The plug connection of claim 1, wherein the housing part is at least partly conductive, and wherein the clamp plug includes a contacting element for electrical contacting of the housing part.

13. The plug connection of claim 12, wherein the contacting element includes a screw guided through the clamp plug by a sleeve, and wherein the housing part includes internal threads into which the screw can be screwed.

14. The plug connection of claim 12, wherein the circuit board includes a second cutout for receiving the contacting element.

15. The plug connection of claim 4, wherein the electrically insulating platform provides electrical insulation between connections of the electrical cable and screwheads of clamping screws of the clamping apparatuses.

16. The plug connection of claim 6, wherein the clamp plug is configured to prevent removal of the at least one clamping screw from the clamping apparatus.

* * * * *